US006471575B1

(12) United States Patent
Hotani

(10) Patent No.: US 6,471,575 B1
(45) Date of Patent: Oct. 29, 2002

(54) BRUSH ROLL AND ITS BRUSH DEVICE

(75) Inventor: Setsuo Hotani, Wakayama (JP)

(73) Assignee: Hotani Co., Ltd., Wakayama (JP)

( * ) Notice: Subject to any disclaimer, the term of this patent is extended or adjusted under 35 U.S.C. 154(b) by 0 days.

(21) Appl. No.: 09/806,246

(22) PCT Filed: Sep. 30, 1998

(86) PCT No.: PCT/JP98/04435

§ 371 (c)(1),
(2), (4) Date: Mar. 27, 2001

(87) PCT Pub. No.: WO00/18545

PCT Pub. Date: Apr. 6, 2000

(51) Int. Cl.[7] ..... B24B 9/02
(52) U.S. Cl. ..... 451/466; 451/469; 451/342
(58) Field of Search ..... 451/466, 469, 451/342, 484, 49, 59; 29/895.3, 895.32, 895.33, 898.068

(56) References Cited

U.S. PATENT DOCUMENTS 4,993,198 A * 2/1991 Hotani ..... 51/334
5,575,704 A * 11/1996 Hotani ..... 451/36

FOREIGN PATENT DOCUMENTS

JP 60-127975 7/1985
JP 10-291165 11/1998

* cited by examiner

*Primary Examiner*—George Nguyen
*Assistant Examiner*—Dung Van Nguyen
(74) *Attorney, Agent, or Firm*—Knobbe, Martens, Olson and Bear, LLP

(57) ABSTRACT

A brush element U includes an assembly of annular disks 2 joined together as arranged side by side. Each disk has polishing bristles or cleaning yarns 1 implanted in its outer periphery. The brush elements U are arranged side by side around a shaft 3. The brush element U is engageable with the shaft 3 by keyways 5 formed in both a peripheral surface of the shaft 3 and an inner peripheral surface of the brush element U and by sunk keys 4 fitted in the respective keyways 5. The sunk keys 4 have a length not larger than the length of the brush elements U, and each of the sunk keys 4 is expandable or contractable widthwise and tightly engageable in the keyway 5 when being expanded. The sunk key 4 is disengageable therefrom when being contracted. The sunk key 4 is prevented from slipping out of the keyway 5 by a retainer C when being contracted and fitted in the keyway 5. The brush roll and brush elements thereof are useful for grinding, polishing cleaning or otherwise treating steel sheets, plates, or strips.

9 Claims, 12 Drawing Sheets

BRUSH ROLL AND ITS BRUSH DEVICE

This application is the U.S. National Phase under 35 U.S.C. §371 of International Application PCT/JP98/04435, filed Sep. 30, 1998.

TECHNICAL FIELD

The present invention relates to brush rolls and brush elements therefor for use in grinding, polishing, cleaning or otherwise treating steel sheets, plates or strips (hereinafter referred to briefly as "steel plates") in the iron manufacturing industry, and more particularly to brush rolls of the type wherein a brush element fitted around a shaft comprises annular disks arranged side by side and each having polishing bristles or cleaning yarns implanted in the outer periphery thereof, and also to the brush element.

Such a brush roll needs to be replaced by a new one when worn, and the replacement interval is not long. The brush roll has its shaft supported at each of its opposite ends by a bearing on a roll chock.

BACKGROUND ART

Brush rolls of the type mentioned conventionally have the following construction. Many annular disks each having polishing bristles or cleaning yarns implanted in the outer periphery thereof and for use in one roll are arranged side by side and fitted around a shaft to obtain an assembly, which is compressed at its opposite sides under a great pressure and held compressed by flanges secured to the shaft. Accordingly, the brush roll must be replaced by a new one, with the annular disks connected to the shaft. If the flange on the shaft is inadvertently loosened to separate the disk assembly from the shaft, the annular disks are abruptly released from compression to jump about instantly, hence a hazard.

To replace the brush roll by a new one with the disk assembly connected to the shaft, the roll chock and the bearing must be disassembled or demounted, removed and reinstalled at each shaft end for old and new rolls. In other words, roll chocks which are four in total number and bearings, four in total number, need to be disassembled, removed and reinstalled. The roll chock is not always easy to disassemble and remove. The bearing which is tightly secured to the shaft with a shrinkage fit is considerably difficult to separate or remove from the shaft, while it is also difficult to mount thereon because of the need for a shrinkage fit. It is therefore not too much to say that extreme difficulties are encountered in disassembling, removing and reinstalling four roll chocks which are not always easy to handle, and in separating, removing and reinstalling four bearings which are considerably difficult to handle. The brush roll equipped with the shaft usually weighs about 1 ton, so that it is not easy to remove the brush roll itself from the frame of the brush roll machine, to reinstall the roll thereon and to transport the roll between the user and the manufacturer.

The construction of the brush roll wherein the annular disks are fitted around the shaft means that a clearance is needed between the shaft and the disks. Conventionally, a brush element is engaged with the shaft by conventional keys and keyways to transmit the torque of the shaft to the brush element. The operation of the brush roll therefore causes the deflection of the roll axis that would produce faults in the quality such as chatter marks. For this reason, the conventional brush roll still remains to be improved for use in grinding or polishing steel plates of which high accuracy is required.

An object of the present invention is to facilitate the replacement of the old brush roll of the type described first by a new one.

Another object of the invention is to assure brush rolls of easier maintenance than conventionally for use in grinding, polishing, cleaning or otherwise treating steel plates of different widths.

Still another object of the invention is to solve the problem of the deflection of the roll axis involved in the prior art.

DISCLOSURE OF THE INVENTION

The present invention provides brush rolls having the following respective constructions 1, 2.

1. A brush roll characterized in that the brush roll comprises a plurality of brush elements fitted around a shaft and arranged side by side longitudinally of the shaft, each of the brush elements comprising an assembly of annular disks joined together as arranged side by side in the direction of width thereof and each having polishing bristles or cleaning yarns implanted in an outer periphery thereof, each of the brush elements being held in engagement with the shaft by keyways formed in both a peripheral surface of the shaft and an inner peripheral surface of the brush element and equidistantly spaced apart circumferentially of the peripheral surfaces and by sunk keys fitting in the respective keyways, the sunk keys and the keyways being each so profiled in cross section that the sunk key is prevented from slipping out of the keyway radially of the brush element, the sunk keys having a length not larger than the length of the brush element, each of the sunk keys being expandable or contractable widthwise thereof and tightly engageable in the keyway when expanded and disengageable therefrom when contracted, the sunk key being prevented from slipping out of the keyway in the brush element longitudinally of the keyway by retaining means when fitted as contracted in the keyway.

2. A brush roll characterized in that the brush roll comprises a plurality of brush elements fitted around a shaft and arranged side by side longitudinally of the shaft, each of the brush elements comprising an assembly of annular disks joined together as arranged side by side in the direction of width thereof and each having polishing bristles or cleaning yarns implanted in an outer periphery thereof, each of the brush elements being held in engagement with the shaft by keyways formed in both a peripheral surface of the shaft and an inner peripheral surface of the brush element and equidistantly spaced apart circumferentially of the peripheral surfaces and by sunk keys fitting in the respective keyways, the sunk keys and the keyways being each so profiled in cross section that the sunk key is prevented from slipping out of the keyway in the brush element radially of the brush element, each the sunk keys comprising a first key member and a second key member each having a length not larger than the length of the brush element, the first key member comprising engaging portions extending in parallel to each other and engageable with side walls defining the keyway, protrusions and recesses formed in an inner side face of each of the engaging portions and arranged alternately longitudinally thereof, bridge portions of the spring type interconnecting the engaging portions while rendering the engaging portions movable toward or away from each other widthwise of the first key member and a groove for the second key member to fit in movably longitudinally of the first key member, the parallel engaging portions of the first key member being tightly engageable in the keyway when moved away from each other widthwise and disengageable therefrom when moved toward each other widthwise, the second key member having outer side faces each provided with recesses and protrusions conforming in shape and arrangement to the protrusions and the recesses arranged alternately along the inner side face of the engaging portion, intermediate portions between the protrusions of engaging portion of the first key member and the recesses thereof and intermediate portions between the recesses of the second key member and the protrusions thereof being so inclined that the second key member is movable relative to the first key member longitudinally thereof, the second key member having at one end thereof stoppers removable by cutting or breaking and cooperative with a removable spacer to be attached to said one end for limiting the depth of longitudinal insertion of the second key member into the groove relative to the first key member, the first key member further having an indented portion formed in one end face thereof for permitting the stoppers to move in with the longitudinal movement of the second key member, and stoppers disposed at the other end face thereof for bearing contact with an end face of the brush element close to a shaft bore thereof.

The present invention provides brush elements having the following respective constructions 3, 4.

3. A brush element characterized in that the brush element comprises an assembly of annular disks joined together as arranged side by side in the direction of width thereof and each having polishing bristles or cleaning yarns implanted in an outer periphery thereof to provide an assembly of brush elements as fitted around a shaft and arranged side by side longitudinally of the shaft, the brush element being engageable with the shaft by keyways formed in both a peripheral surface of the shaft and an inner peripheral surface of the brush element and equidistantly spaced apart circumferentially of the peripheral surfaces and by sunk keys fitting in the respective keyways, the sunk keys and the keyways being each so profiled in cross section that the sunk key is prevented from slipping out of the keyway in the brush element radially of the brush element, the sunk keys having a length not larger than the length of the brush element, each of the sunk keys being expandable or contractable widthwise thereof and tightly engageable in the keyway when expanded and disengageable therefrom when contracted, the sunk key being prevented from slipping out of the keyway in the brush element longitudinally of the keyway by retaining means when fitted as contracted in the keyway.

4. A brush element characterized in that the brush element comprises an assembly of annular disks joined together as arranged side by side in the direction of width thereof and each having polishing bristles or cleaning yarns implanted in an outer periphery thereof to provide an assembly of brush elements as fitted around a shaft and arranged side by side longitudinally of the shaft, the brush element being engageable with the shaft by keyways formed in both a peripheral surface of the shaft and an inner peripheral surface of the brush element and equidistantly spaced apart circumferentially of the peripheral surfaces and by sunk keys fitting in the respective keyways, the sunk keys and the keyways being each so profiled in cross section that the sunk key is prevented from slipping out of the keyway in the brush element radially of the brush element, each the sunk keys comprising a first key member and a second key member each having a length not larger than the length of the brush element, the first key member comprising engaging portions extending in parallel to each other and engageable with side walls defining the keyway, protrusions and recesses formed in an inner side face of each of the engaging portions and arranged alternately longitudinally thereof, bridge portions of the spring type interconnecting the engaging portions while rendering the engaging portions movable toward or away from each other widthwise of the first key member and a groove for the second key member to fit in movably longitudinally of the first key member, the parallel engaging portions of the first key member being tightly engageable in the keyway when moved away from each other widthwise and disengageable therefrom when moved toward each other widthwise, the second key member having outer side faces each provided with recesses and protrusions conforming in shape and arrangement to the protrusions and the recesses arranged alternately along the inner side face of the engaging portion, intermediate portions between the protrusions of engaging portion of the first key member and the recesses thereof and intermediate portions between the recesses of the second key member and the protrusions thereof being so inclined that the second key member is movable relative to the first key member longitudinally thereof, the second key member having at one end thereof stoppers removable by cutting or breaking and cooperative with a removable spacer to be attached to said one end for limiting the depth of longitudinal insertion of the second key member into the groove relative to the first key member, the first key member further having an indented portion formed in one end face thereof for permitting the stoppers to move in with the longitudinal movement of the second key member, and stoppers disposed at the other end face thereof for bearing contact with an end face of the brush element close to the shaft.

The term "cleaning yarns" as used herein in connection with the present invention refers generally to linear materials for use in cleaning steel sheets or plates by brushing. This is also true with the appended claims and with the following description.

While the brush element included in conventional brush rolls comprises an assembly of annular disks arranged side by side in the direction of width thereof and each having polishing bristles or cleaning yarns implanted in the outer periphery thereof, the term the "brush element" according to the invention refers to a unit corresponding to one of the segments obtained by dividing the brush element of the prior art along the length thereof, and joining the juxtaposed annular disks of each segment. The brush element of the invention is of course provided with keyways of specified structure at predetermined portions of its inner periphery. The term of brush element thus defined is used in the appended claims and in the following description. The juxtaposed annular disks are joined, for example, by arranging the annular disks side by side with an adhesive medium interposed between each pair of adjacent disks and with the corresponding keyways aligned, and compressing the assembly in the direction of arrangement. The adhesive medium can be of the coating type, and is applied to the annular disks by coating.

According to the invention, the brush element is tightly held in engagement with the shaft by causing the sunk keys to expand widthwise as fitted in the respective keyways formed in the shaft peripheral surface and the inner peripheral surface of the brush element, and is made drivable by the shaft as connected thereto in this way. The brush element is released from the shaft by causing the sunk keys to contract widthwise.

According to the invention, therefore, the brush element is easy to mount on the shaft and easy to remove from the shaft. Furthermore, the brush element alone can be replaced by a new one without the shaft attached thereto for the substantial replacement of the brush roll. This facilitates substantial transport of new and old brush rolls between the user and the manufacturer. Since the brush roll can be replaced by a new one by replacing the brush element only, the roll chock and rolling bearing need to be disassembled, removed and reinstalled for only one side of the shaft roll in replacing the brush roll. This greatly reduces the labor and time conventionally required for the disassembly, removal and reinstallation of these members.

Further when the rolling bearing to be mounted on the roll chock is given an outside diameter smaller than the inside diameter of the brush element, the brush element can be replaced by a new one with the rolling bearing mounted on the shaft. This eliminates the need to handle the rolling bearing which is most difficult to remove from the shaft and to mount thereon. In preparation of exchange of the brush roll, the roll chock of the brush roll machine (see FIG. 23) is generally adapted to be disassembled as shown in FIG. 23. Accordingly, if the outside diameter of the rolling bearing (see FIG. 23) is smaller than the inside diameter of the brush element, the brush element is removable from the shaft and mountable thereon without removing the rolling bearing from the shaft after the roll chock at one side has been disassembled. FIG. 23 shows the procedure for removing the brush element. FIG. 23 shows the brush element schematically, and the roll chock supporting the rolling bearing mounted on the shaft is indicated in chain lines.

In adapting brush rolls for the grinding, polishing, cleaning or other treatment of steel plates of different widths, the present invention ensures easier maintenance than in the prior art. This feature will be described below with reference to a specific example.

For brushing four kinds of steel plates having different widths by a brush roll machine having four brush rolls, there is a need to prepare four kinds of brush rolls having different lengths in conformity with the different widths of four kinds of steel plates. It is then conventionally necessary to stock 16 shaft-equipped brush rolls which are at least about 1 m in length if short. These rolls kept in stock are not easy to maintain.

According to the present invention, unlike the conventional practice, brush elements having a short length corresponding to a fraction of the length of brush rolls, e.g., 1/10 the length of brush rolls, and equipped with no shaft need only to be prepared for grinding, polishing, cleaning or otherwise treating steel plates of different widths, and the stock needed is very easy to maintain.

When the brush element having sunk keys fitted as contracted in the respective keyways in the element are fitted around the shaft according to the invention, a standby state is available in which the brush element can be keyed to the shaft offhandedly. When the sunk keys on the brush element are caused to expand widthwise in this state, the brush element is keyed to the shaft with ease.

According to the invention, the sunk keys and the keyways are each so profiled in cross section that the sunk key is prevented from slipping out of the keyway radially of the brush element, and when fitted as contracted in the keyway in the brush element, the sunk key is prevented from slipping out of the keyway longitudinally thereof by retaining means. Thus, the brush element equipped with the sunk keys is made transportable in such a state that the element can be keyed to the shaft offhandedly.

According to the invention, the keyways formed in both the peripheral surface of the shaft and the inner peripheral surface of the brush element are equidistantly spaced apart circumferentially of the shaft and the brush element. Therefore, when the brush element is keyed to the shaft by causing the sunk keys to expand widthwise as fitted in the respective keyways, the brush element can be centered about the shaft.

When the brush element is keyed to the shaft by causing the sunk keys to expand widthwise as fitted in the respective keyways according to the invention, substantially no clearance remains between the shaft and the brush element. This obviates the conventional problem of the deflection of the axis of the brush roll during operation.

The sunk keys have a length not larger than the length of the brush element. In the case where a required number of brush elements are arranged side by side on the shaft and keyed to the shaft, this feature eliminates the clearance to be otherwise created at the ends of sunk keys. If formed, a clearance will leave the steel plate treated unbrushed at a portion thereof corresponding to the clearance, producing a grinding mark, polishing mark or cleaning mark.

BEST MODE OF CARRYING OUT THE INVENTION

The present invention will be described in greater detail with reference to the accompanying drawings. A brush roll is indicated generally at I. The brush roll I comprises a plurality of brush elements U fitted around a shaft 3 and arranged side by side longitudinally of the shaft, each of the brush elements U comprising an assembly of many annular disks 2 arranged side by side in the direction of width thereof and each having polishing bristles or cleaning yarns (hereinafter referred to briefly as polishing bristles) 1 implanted in the outer periphery thereof. A flange fixedly provided on the shaft 3 is in bearing contact with each of opposite sides of the assembly of brush elements U on the shaft 3.

Figure 1A:
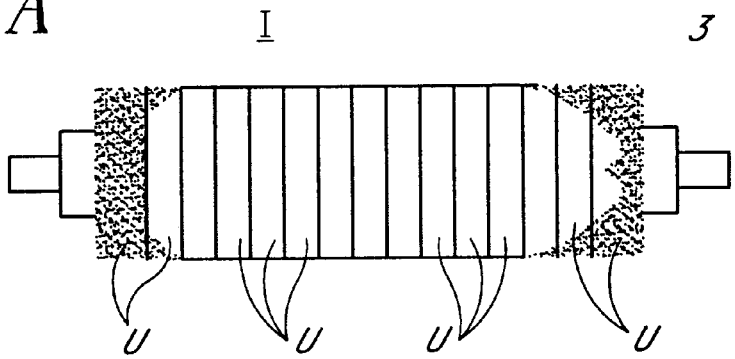
FIG. 1(A) is a front view schematically showing a brush roll embodying the invention.
Figure 1B:
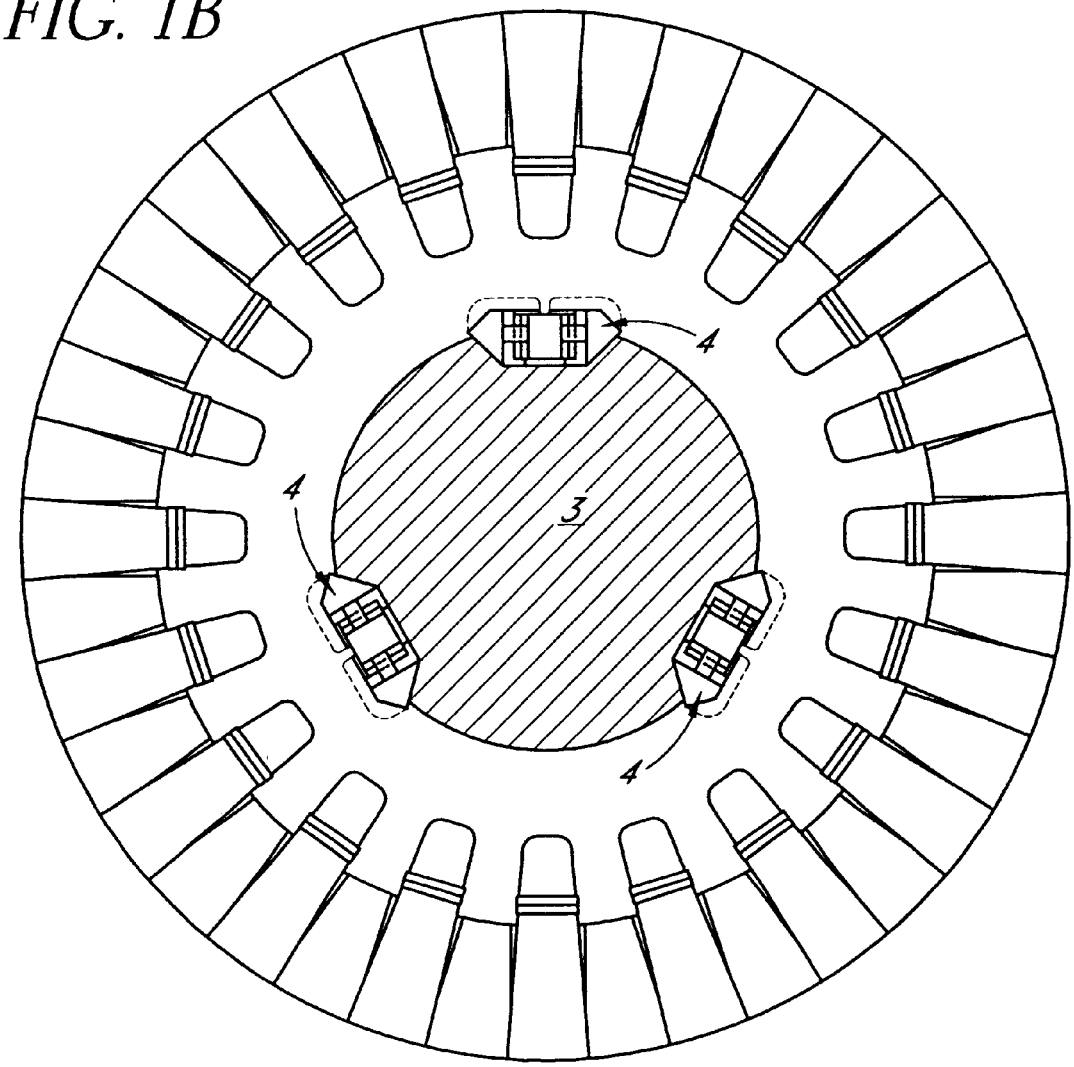
FIG. 1(B) is a view in section of a preferred brush roll according to the invention.
Figure 2:
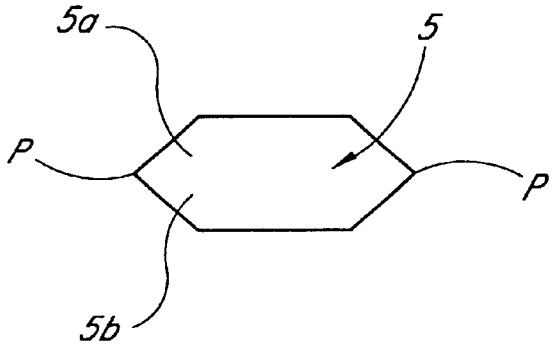
FIG. 2 is a front view of a keyway shown in FIG. 1(A).
Figure 3:
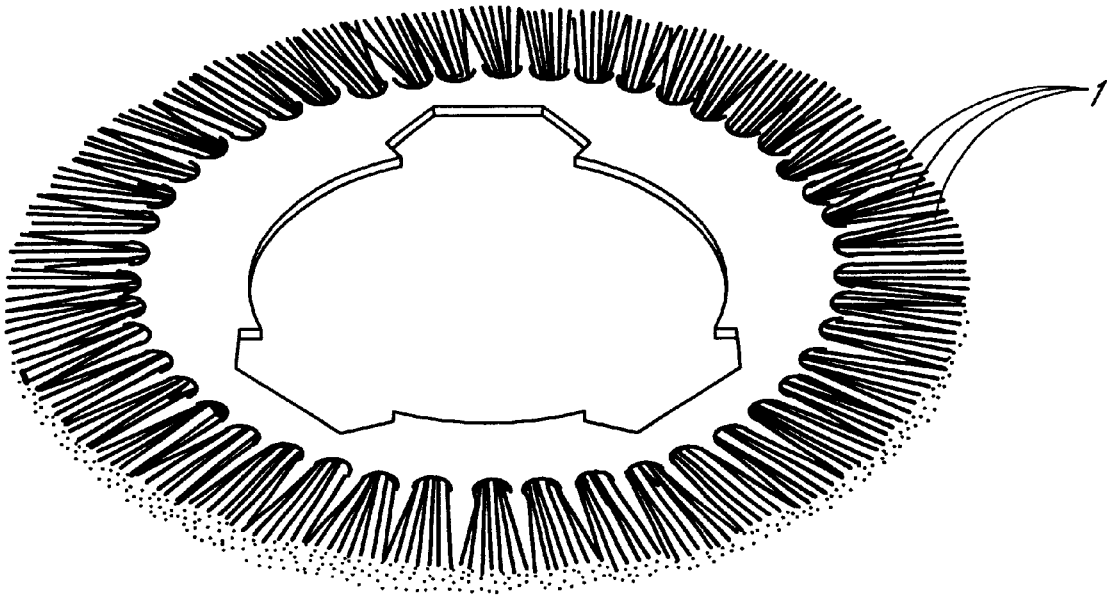
FIG. 3 is a perspective view of a preferred annular disk according to the invention.

Each of the brush elements U is held in engagement with the shaft 3 having these elements as arranged thereon side by side by keyways 5 formed in both the outer peripheral surface of the shaft 3 and the inner peripheral surface of the brush element U and equidistantly spaced apart circumferentially of these peripheral surfaces and by sunk keys 4 fitting in the respective keyways 5. The keyways 5 extend over the entire length of the shaft 3. The sunk key 4 and the keyway 5 are so profiled in cross section that the sunk key 4 is prevented from slipping out of the keyway 5*a* radially of the brush element U. The sunk key 4 and the keyway 5 have a cross sectional profile comprising a generally trapezoidal area on the brush element side and an inverted trapezoidal area on the shaft side. Preferably, the points p of contact between these trapezoidal and inverted trapezoidal contours or outlines are positioned, for example, outwardly of the outer periphery of the shaft 3 and inwardly the brush element U (FIG. 1(B), FIG. 2, FIG. 3). The positions of the contact points p inside the brush element U are on the line of a circle concentric with the brush element U so as to center the brush element U about the shaft 3. The degree to which the contact points p are positioned inwardly of the brush element U may be small.

The sunk key 4 has a length not larger than the length of the brush element U. The sunk key 4 is expandable and contractable widthwise thereof and tightly engages in the keyway 5 when expanded. The sunk key 4 can be released from the engagement when contracted widthwise thereof. When fitted as contracted in the keyway 5*a* in the brush element U, the sunk key 4 is prevented from slipping out of the keyway 5*a* longitudinally thereof by retaining means C. Preferably, the retaining means C comprises the stoppers S1, S2 and spacer S to be described below. The sunk key 4 has the structure to be described below in detail.

Figure 4:
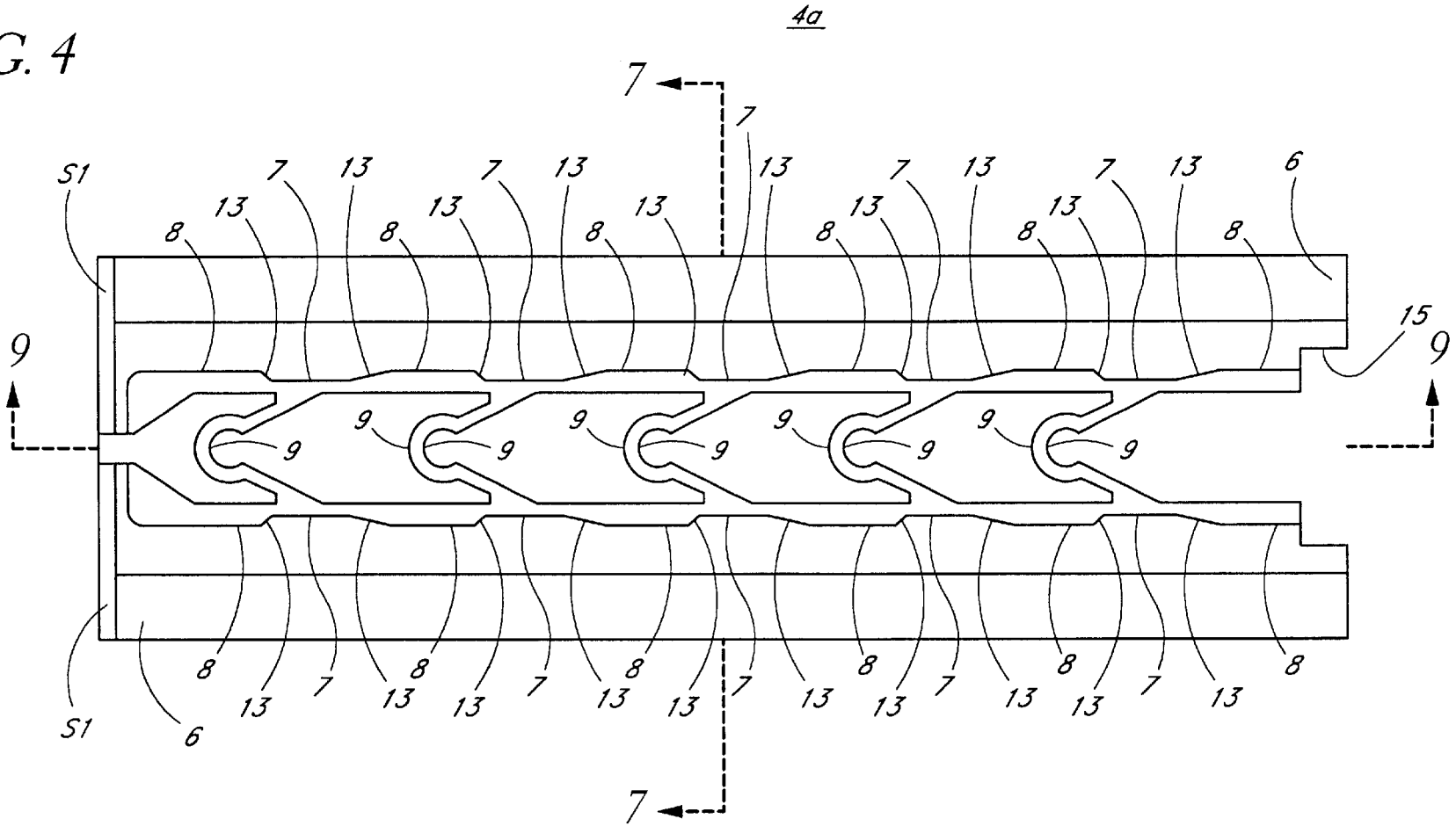
FIG. 4 is a plan view of a preferred first key member of a sunk key according to the invention.
Figure 5:
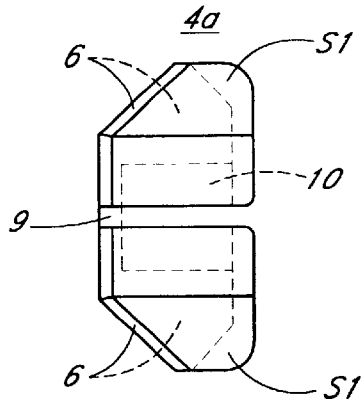
FIG. 5 is a left side elevation of the key member shown in FIG. 4.
Figure 6:
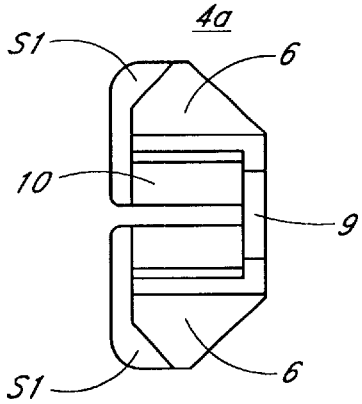
FIG. 6 is a right side elevation of the key member.
Figure 7:
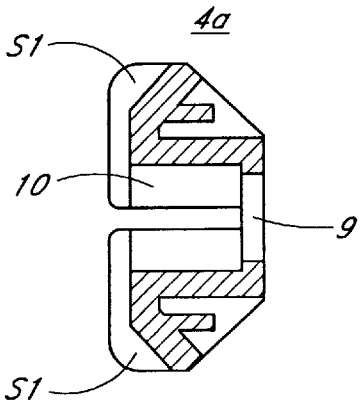
FIG. 7 is a view in section taken along the line VII—VII in FIG. 4.
Figure 8:
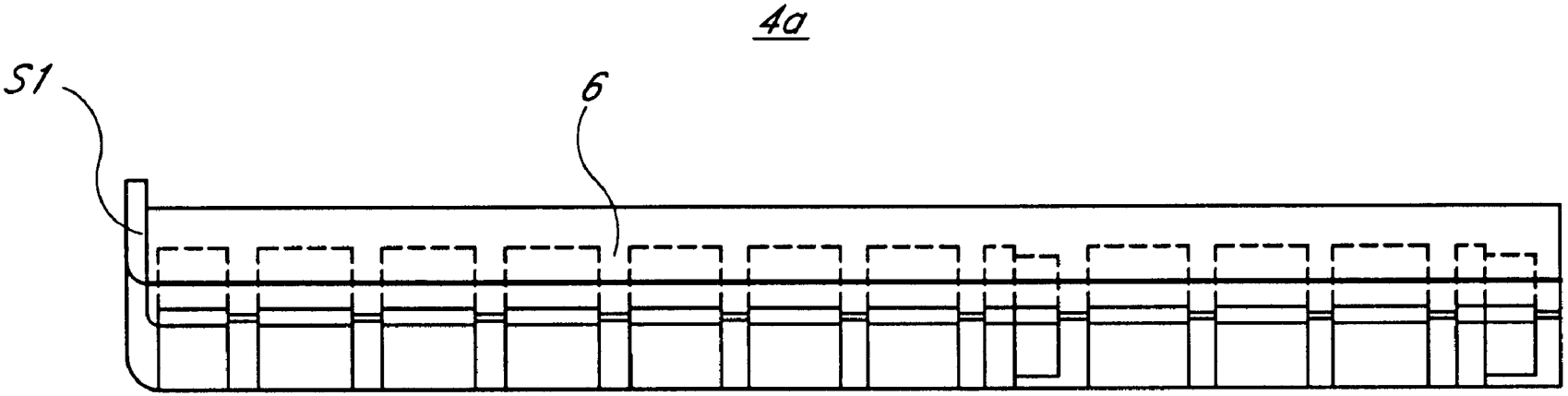
FIG. 8 is a front view of FIG. 4.
Figure 9:
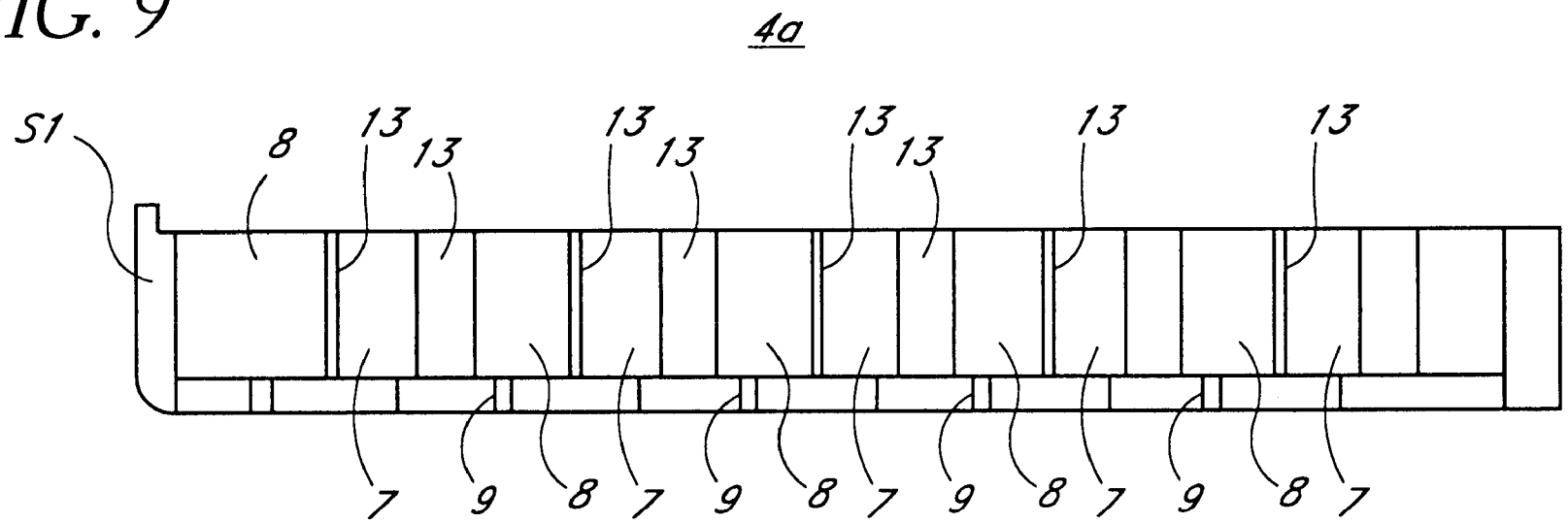
FIG. 9 is a view in section taken along the line IX—IX in FIG. 4.
Figure 10:
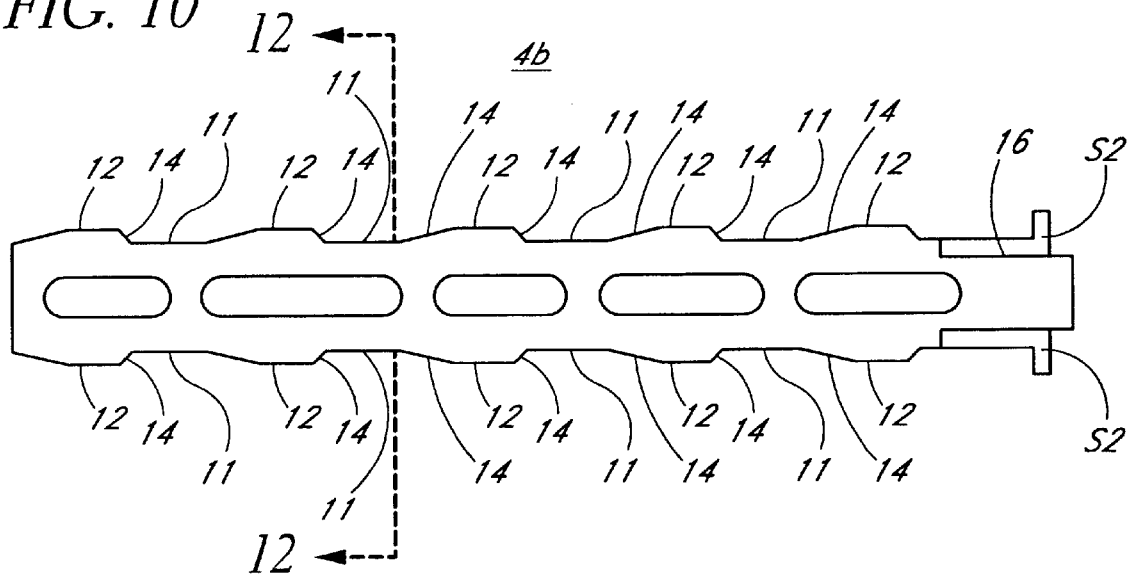
FIG. 10 is a plan view of a preferred second key member of the sunk key of the invention.
Figure 11:
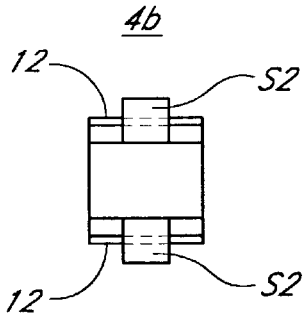
FIG. 11 is a right side elevation of the key member shown in FIG. 10.
Figure 12:
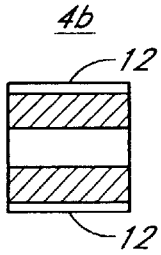
FIG. 12 is a view in section taken along the line XII—XII in FIG. 10.
Figure 13:
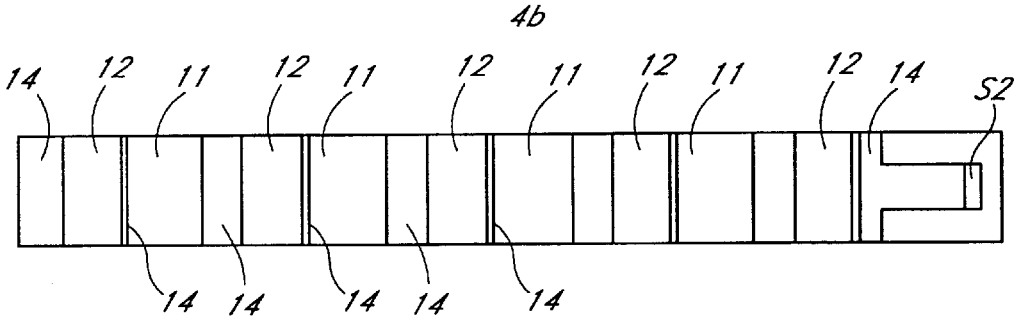
FIG. 13 is a front view of FIG. 10.
Figure 14:
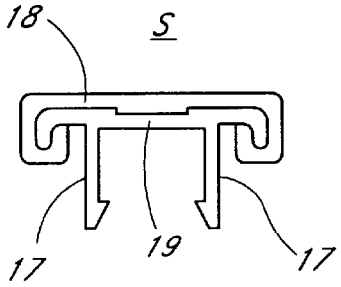
FIG. 14 is a front view of a preferred spacer according to the invention.
Figure 15:
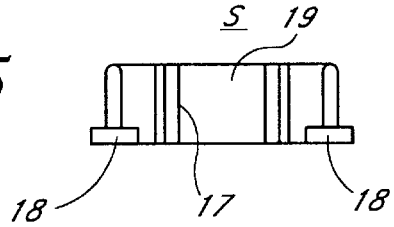
FIG. 15 is a bottom view of the spacer.
Figure 16:
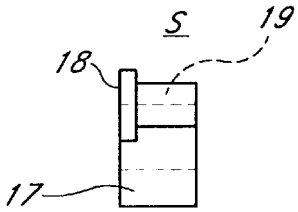
FIG. 16 is a side elevation of the spacer.

The sunk key 4 comprises a first key member 4a (see FIG. 4) and a second key member 4*b* (see FIG. 10) each of which is not longer than the length of the brush element U. With reference to FIG. 4, the first key member 4*a* comprises engaging portions 6 extending in parallel to each other longitudinally of the member 4*a*. As will be described later, the engaging portions 6 engage with side walls defining a keyway portion 5*a* in the brush element U and a keyway portion 5*b* in the shaft 3. The inner side face of each engaging portion 6 of first key member 4*a* is provided with protrusions 7 and recesses 8 arranged alternately longitudinally of the member 4*a*. The first key member 4*a* further has bridge portions 9 of the spring type arranged longitudinally thereof and interconnecting the engaging portions 6, 6 while rendering these portions 6, 6 movable toward or away from each other widthwise of the member 4*a*. The first key member 4*a* further has a groove 10 for the second key member 4*b* to fit in forwardly (leftwardly in FIG. 10) movably longitudinally thereof. As shown in FIG. 10, the second key member 4*b* has outer side faces each provided with recesses 11 and protrusions 12 arranged alternately longitudinally of the member 4*b*. In shape and arrangement, the recesses 11 and the protrusions 12 are in conformity with the protrusions 7 and the recesses 8 arranged alternately along the inner side face of the engaging portion 6. Stated more specifically, these portions are so shaped and arranged that the protrusions 7 are fittable in the recesses 11, and the protrusions 12 in the recesses 8. Intermediate portions 13 between the protrusions 7 of engaging portion 6 of the first key member 4*a* and the recesses 8 thereof, and intermediate portions 14 between the recesses 11 of the second key member 4*b* and the protrusions 12 thereof are inclined so that the second key member 4*b* is forwardly movable relative to the first key member 4*a* longitudinally thereof.

The second key member 4*b* further has at its rear end stoppers S2 which can be cut or broken off. The stoppers S cooperate with a removable spacer S (see FIG. 14 to FIG. 16, FIG. 17 to FIG. 20) to be attached to the rear end of the second key member 4*b* to limit the depth of longitudinal forward insertion of the second key member 4*b* into the groove 10 relative to the first key member 4*a*. The first key member 4*a* further has an indented portion 15 formed in the end thereof to be opposed to the stoppers S2 for permitting the stoppers S2 to move in with the forward movement of the second key member 4*b*, and stoppers S1 disposed at the other end thereof for bearing contact with the outer surface of inner edge of the brush element U.

The spacer S has a portion 19 to be positioned over a portion 16 of the second key member 4*b* which portion 16 is adjacent to the stoppers S2 inside thereof (at the left-hand side of FIG. 10, a plan view showing the second key member 4*b*), two legs 17, 17 fittable over the portion 16 as if straddling, and a contact portion 18 to be in bearing contact with an end face of the brush element U. The spacer S is made of a resin molding, the elasticity of which renders the legs 17, 17 removably fittable to the portion 16. Thus, the spacer as fitted to the end of the key member 4*b* is removable therefrom.

Figure 18:
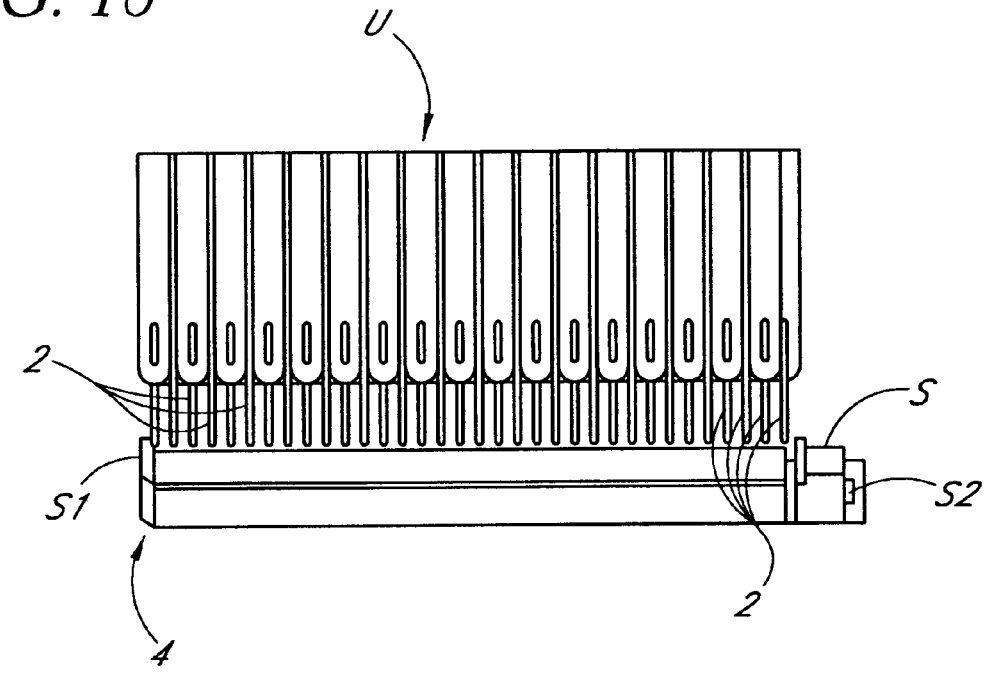
FIG. 18 is a sectional view showing the sunk key fitting as contracted in the keyway in a brush element, the portion of the brush element below the sunk key being omitted from the sectional view.
Figure 19:
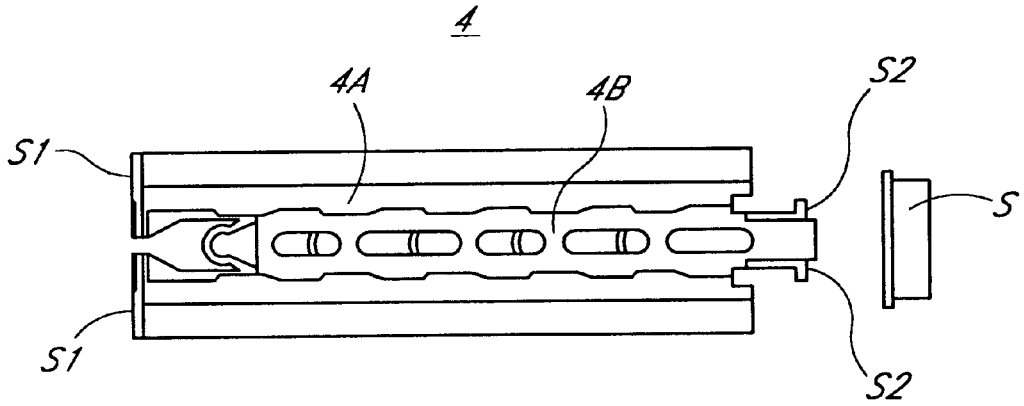
FIG. 19 is a plan view of the sunk key as contracted, with the spacer removed therefrom.
Figure 20:
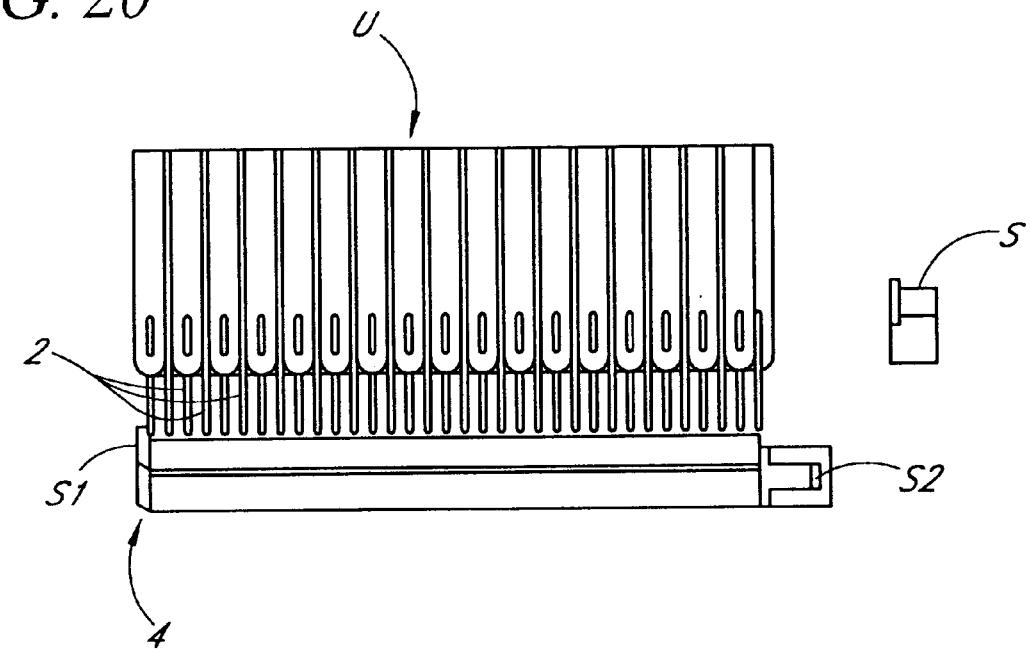
FIG. 20 is a sectional view showing the sunk key in the state shown in FIG. 19 and as fitted in the keyway in the brush element, the portion of the brush element below the sunk key being omitted from the sectional view.

The sunk key 4 is assembled by fitting the second key member 4*b* into the groove 10 of the first key member 4*a*. FIG. 18 shows the sunk key 4 as fitted in the keyway portion 5*a* in the brush element U. (In FIG. 18, the sunk key 4 conceals the keyway portion 5*a* from view.) In this state, the spacer S is disposed between the end face of the brush element U and the stoppers S2 of the second key member 4*b*.

Figure 17:
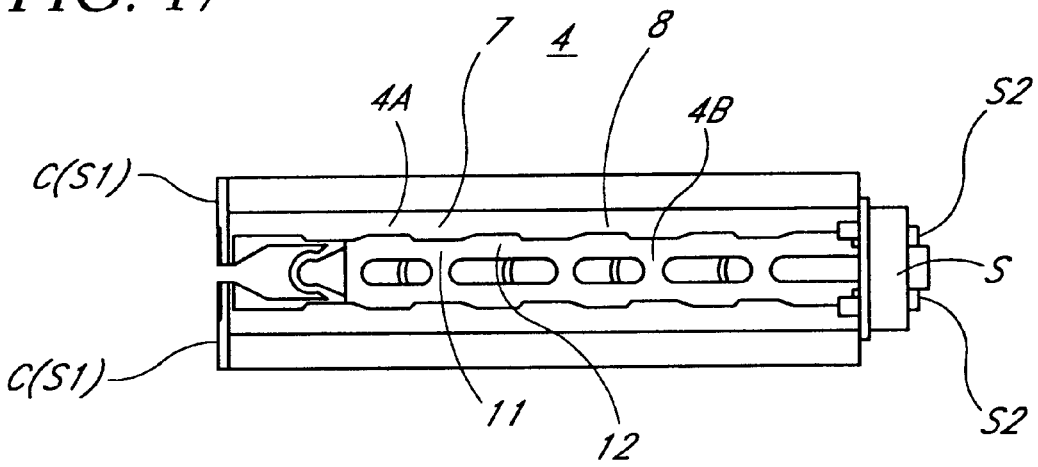
FIG. 17 is a plan view showing the sunk key of the invention as contracted.

The spacer S as fitted to the key member 4*b* cooperates with the stoppers S2 to restrain the second key member 4*b* from moving leftward in FIG. 17 relative to the first key member 4*a* on the brush element U, thus acting to limit the depth of longitudinal forward insertion of the second key member 4*b* into the groove 10 relative to the first key member 4*a*. The stoppers S1 at the other end of the first key member 4*a* restrain the first key member 4*a* from moving rightward in FIG. 18 relative to the brush element U. In this state, the brush element U is provided with sunk keys 4 and can therefore be stocked as intended as will be described later.

Further in this state, the protrusions 12 of the second key member 4*b* fit in the recesses 8 of the first key member 4*a*, and the recessed portions 11 of the second key member 4*b* fit to the protrusions 7 of the first key member 4*a* to hold the sunk key 4 in a contracted state without tightening up the first key member 4*a* relative to the keyway portion 5*a* of the brush element U. This state is also a standby state in which the brush element U can be keyed to the shaft 3 offhandedly by sunk keys 4 each comprising first and second key members 4*a*, 4*b*.

Figure 21:
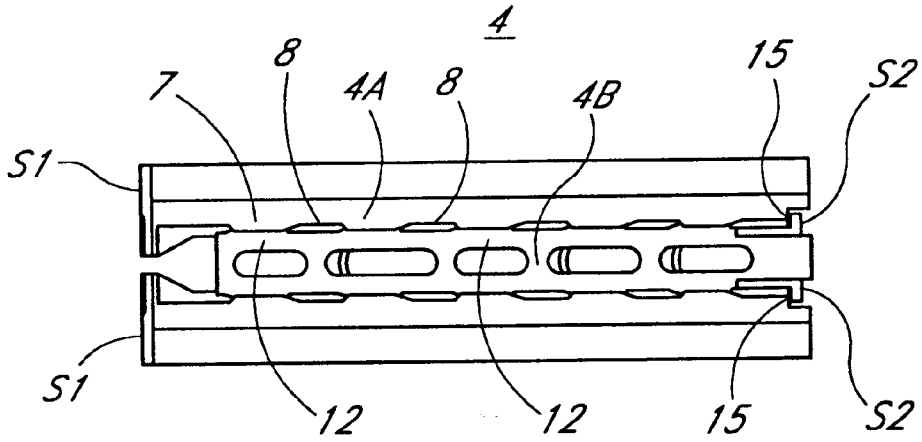
FIG. 21 is a plan view of the sunk key as contracted widthwise by pushing the second key member from the state of FIG. 19 relative to the first key member.
Figure 22:
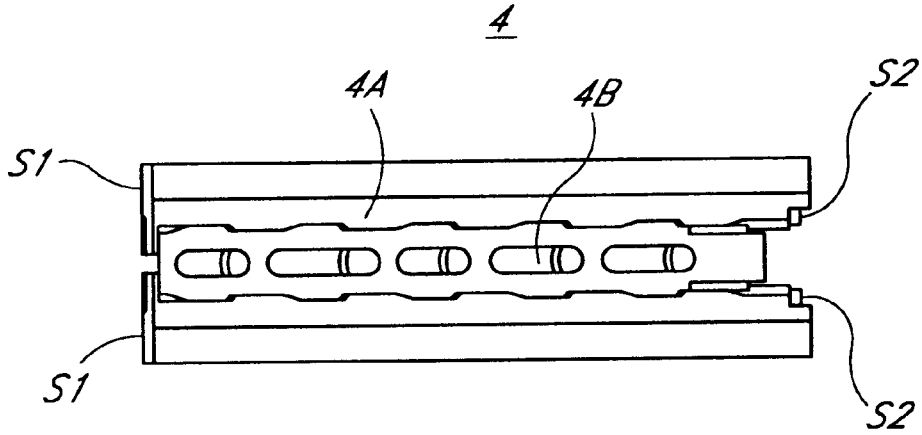
FIG. 22 is a plan view of the key as contracted by pushing the second key member further from the state of FIG. 21 relative to the first key member.
Figure 23:
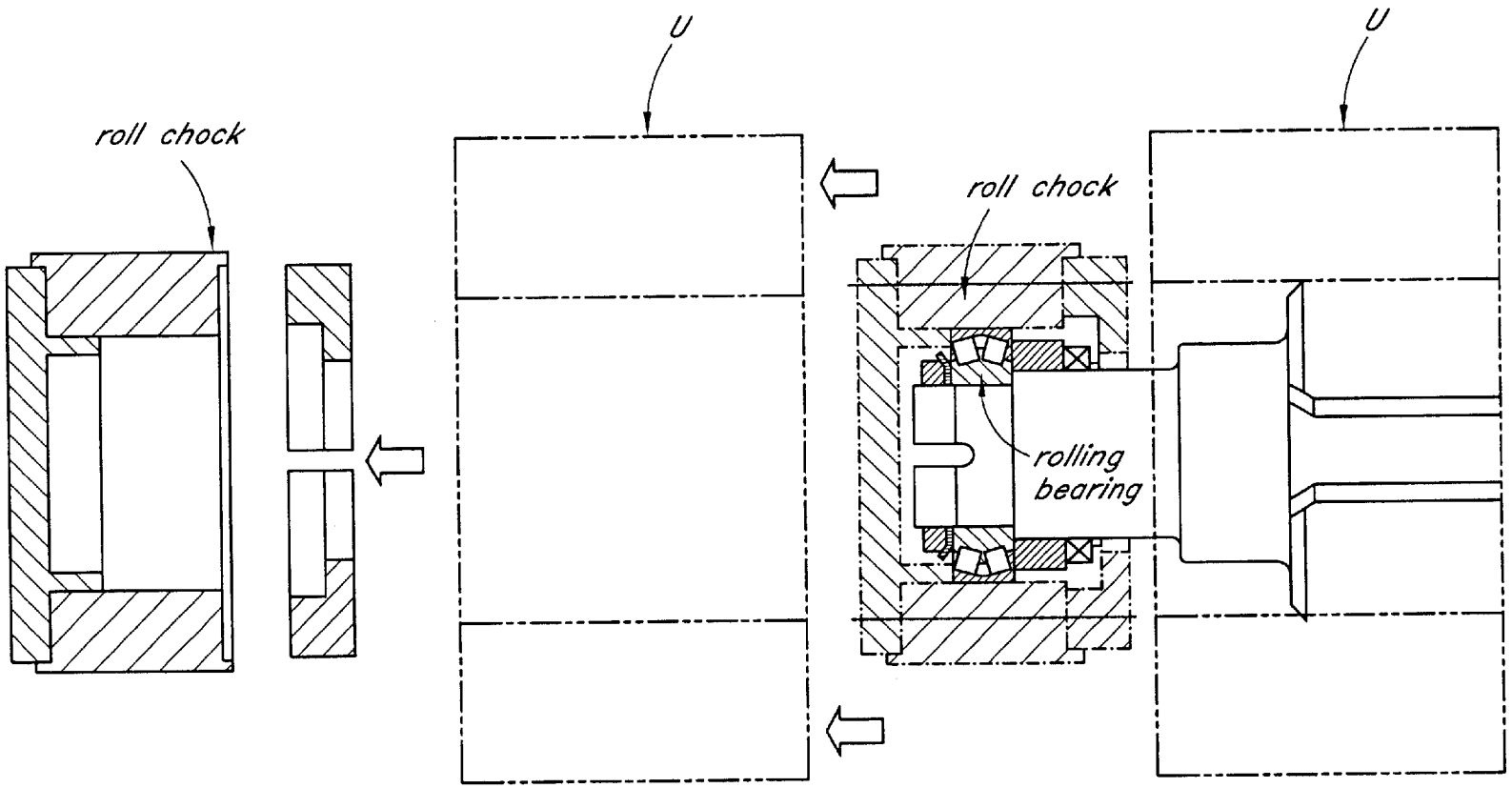
FIG. 23 is reference diagram showing a procedure for removing a roll element from a shaft and mounting the element thereon.

The brush element U having sunk keys 4 fitted in the respective keyway portions 5*a* in a contracted state can be keyed to the shaft 3 by fitting the brush element U having the sunk keys 4 around the shaft 3 from one end thereof, removing the spacers S (FIG. 19, FIG. 20), and pushing each second key member 4*b* toward the stoppers S1 relative to the first key member 4*a* on the brush element U. In this case, the indented portion 15 in the end face of the first key member 4*a* permits the second key member 4*b* to be pushed forward relative to the first key member 4*a*. FIG. 21 shows the member 4*b* as pushed in.

When the second key member 4*b* is thus pushed in, the protrusions 12 of the member 4*b* are opposed to the protrusions 7 of the first key member 4*a*, moving the parallel engaging portions 6, 6 of the member 4*a* away from each other widthwise thereof. In this way, the sunk key 4 is tightly engaged in the keyway portion 5*a* of the brush element U and keyway portion 5*b* of the shaft 3, i.e., in the keyway 5. The other Brush elements U are mounted on and keyed to the shaft 3 in the same manner as above.

When the second key member 4*b* in the sunk key 4 engaged in the keyway 5 for the brush element U as keyed to the shaft 3 is further pushed toward the stoppers S1 relative to the first key member 4*a* on the brush element U, each protrusion 12 of the second key member 4*b* in engagement with the protrusion 7 of the first key member 4 is fitted into the recess 8 which is immediately adjacent to this protrusion 7 toward the pushing direction, whereby the sunk key 4 is contracted. In this case, the stoppers S2 of the second key member 4*b* are pushed by the bottom of the indented portion 15 and removed by being torn off from the second key member 4*b*, by forcibly pushing the second key member 4*b* relative to the first key member 4*a* further forward as described above. The stoppers S2 may be removed by cutting as with a cutter without forcibly pushing the member 4*b*.

In this way, the brush element U is easily removable from the shaft 3 even by a manual procedure. The fact that the sunk key as tightly engaged in the keyway is releasable therefrom by pushing the second key member relative to the first key member in this way means that the sunk key is easily disengageable.

INDUSTRIAL APPLICABILITY

The brush roll according to the invention is useful as such in grinding, polishing, cleaning or otherwise treating steel plates. The brush element is useful as a brush element for use in the brush roll.

What is claimed is:

1. A brush roll characterized in that the brush roll comprises a plurality of brush elements fitted around a shaft and arranged side by side longitudinally of the shaft, each of the brush elements comprising an assembly of annular disks joined together as arranged side by side in the direction of width thereof and each having polishing bristles or cleaning yarns implanted in an outer periphery thereof, each of the brush elements being held in engagement with the shaft by keyways formed in both a peripheral surface of the shaft and an inner peripheral surface of the brush element and equidistantly spaced apart circumferentially of the peripheral surfaces and by sunk keys fitting in the respective keyways, the sunk keys and the keyways being each so profiled in cross section that the sunk key is prevented from slipping out of the keyway radially of the brush element, the sunk keys having a length not larger than the length of the brush element, each of the sunk keys being expandable or contractable widthwise thereof and tightly engageable in the keyway when expanded and disengageable therefrom when contracted, the sunk key being prevented from slipping out of the keyway in the brush element longitudinally of the keyway by retaining means when fitted as contracted in the keyway.

2. A brush roll according to claim 1 which is characterized in that the sunk key and the keyway for the sunk key to fit in have a cross sectional profile comprising a generally trapezoidal area on the brush element side and an inverted trapezoidal area on the shaft side with respect to the radial direction of the brush element and the shaft, and the points of contact between these trapezoidal and inverted trapezoidal contours or outlines are positioned outwardly of the shaft and inwardly of the brush element and also positioned on the line of a circle concentric with the brush element.

3. A brush roll characterized in that the brush roll comprises a plurality of brush elements fitted around a shaft and arranged side by side longitudinally of the shaft, each of the brush elements comprising an assembly of annular disks joined together as arranged side by side in the direction of width thereof and each having polishing bristles or cleaning yarns implanted in an outer periphery thereof, each of the brush elements being held in engagement with the shaft by keyways formed in both a peripheral surface of the shaft and an inner peripheral surface of the brush element and equidistantly spaced apart circumferentially of the peripheral surfaces and by sunk keys fitting in the respective keyways, the sunk keys and the keyways being each so profiled in cross section that the sunk key is prevented from slipping out of the keyway in the brush element radially of the brush element, each the sunk keys comprising a first key member and a second key member each having a length not larger than the length of the brush element, the first key member comprising engaging portions extending in parallel to each other and engageable with side walls defining the keyway, protrusions and recesses formed in an inner side face of each of the engaging portions and arranged alternately longitudinally thereof, bridge portions of the spring type interconnecting the engaging portions while rendering the engaging portions movable toward or away from each other widthwise of the first key member and a groove for the second key member to fit in movably longitudinally of the first key member, the parallel engaging portions of the first key member being tightly engageable in the keyway when moved away from each other widthwise and disengageable therefrom when moved toward each other widthwise, the second key member having outer side faces each provided with recesses and protrusions conforming in shape and arrangement to the protrusions and the recesses arranged alternately along the inner side face of the engaging portion, intermediate portions between the protrusions of engaging portion of the first key member and the recesses thereof and intermediate portions between the recesses of the second key member and the protrusions thereof being so inclined that the second key member is movable relative to the first key member longitudinally thereof, the second key member having at one end thereof stoppers removable by cutting or breaking and cooperative with a removable spacer to be attached to said one end for limiting the depth of longitudinal insertion of the second key member into the groove relative to the first key member, the first key member further having an indented portion formed in one end face thereof for permitting the stoppers to move in with the longitudinal movement of the second key member, and stoppers disposed at the other end face thereof for bearing contact with an end face of the brush element close to a shaft bore thereof.

4. A brush roll according to claim 3 which is characterized in that the sunk key and the keyway for the sunk key to fit in have a cross sectional profile comprising a generally trapezoidal area on the brush element side and an inverted trapezoidal area on the shaft side with respect to the radial direction of the brush element and the shaft, and the points of contact between these trapezoidal and inverted trapezoidal contours or outlines are positioned outwardly of the shaft and inwardly of the brush element and also positioned on the line of a circle concentric with the brush element.

5. A brush element characterized in that the brush element comprises an assembly of annular disks joined together as arranged side by side in the direction of width thereof and each having polishing bristles or cleaning yarns implanted in an outer periphery thereof to provide an assembly of brush elements as fitted around a shaft and arranged side by side longitudinally of the shaft, the brush element being engageable with the shaft by keyways formed in both a peripheral surface of the shaft and an inner peripheral surface of the brush element and equidistantly spaced apart circumferentially of the peripheral surfaces and by sunk keys fitting in the respective keyways, the sunk keys and the keyways being each so profiled in cross section that the sunk key is prevented from slipping out of the keyway in the brush element radially of the brush element, the sunk keys having a length not larger than the length of the brush element, each of the sunk keys being expandable or contractable widthwise thereof and tightly engageable in the keyway when expanded and disengageable therefrom when contracted, the sunk key being prevented from slipping out of the keyway in the brush element longitudinally of the keyway by retaining means when fitted as contracted in the keyway.

6. A brush roll according to claim 5 which is characterized in that the sunk key and the keyway for the sunk key to fit in have a cross sectional profile comprising a generally trapezoidal area on the brush element side and an inverted trapezoidal area on the shaft side with respect to the radial direction of the brush element and the shaft, and the points of contact between these trapezoidal and inverted trapezoidal contours or outlines are positioned outwardly of the shaft and inwardly of the brush element and also positioned on the line of a circle concentric with the brush element.

7. A brush element characterized in that the brush element comprises an assembly of annular disks joined together as arranged side by side in the direction of width thereof and each having polishing bristles or cleaning yarns implanted in an outer periphery thereof to provide an assembly of brush elements as fitted around a shaft and arranged side by side longitudinally of the shaft, the brush element being engageable with the shaft by keyways formed in both a peripheral surface of the shaft and an inner peripheral surface of the brush element and equidistantly spaced apart circumferentially of the peripheral surfaces and by sunk keys fitting in the respective keyways, the sunk keys and the keyways being each so profiled in cross section that the sunk key is prevented from slipping out of the keyway in the brush element radially of the brush element, each the sunk keys comprising a first key member and a second key member each having a length not larger than the length of the brush element, the first key member comprising engaging portions extending in parallel to each other and engageable with side walls defining the keyway, protrusions and recesses formed in an inner side face of each of the engaging portions and arranged alternately longitudinally thereof, bridge portions of the spring type interconnecting the engaging portions while rendering the engaging portions movable toward or away from each other widthwise of the first key member and a groove for the second key member to fit in movably longitudinally of the first key member, the parallel engaging portions of the first key member being tightly engageable in the keyway when moved away from each other widthwise and disengageable therefrom when moved toward each other widthwise, the second key member having outer side faces each provided with recesses and protrusions conforming in shape and arrangement to the protrusions and the recesses arranged alternately along the inner side face of the engaging portion, intermediate portions between the protrusions of engaging portion of the first key member and the recesses thereof and intermediate portions between the recesses of the second key member and the protrusions thereof being so inclined that the second key member is movable relative to the first key member longitudinally thereof, the second key member having at one end thereof stoppers removable by cutting or breaking and cooperative with a removable spacer to be attached to said one end for limiting the depth of longitudinal insertion of the second key member into the groove relative to the first key member, the first key member further having an indented portion formed in one end face thereof for permitting the stoppers to move in with the longitudinal movement of the second key member, and stoppers disposed at the other end face thereof for bearing contact with an end face of the brush element close to the shaft.

8. A brush roll according to claim 7 which is characterized in that the sunk key and the keyway for the sunk key to fit in have a cross sectional profile comprising a generally trapezoidal area on the brush element side and an inverted trapezoidal area on the shaft side with respect to the radial direction of the brush element and the shaft, and the points of contact between these trapezoidal and inverted trapezoidal contours or outlines are positioned outwardly of the shaft and inwardly of the brush element and also positioned on the line of a circle concentric with the brush element.

9. A brush roll comprising: (i) a shaft; (ii) brush elements composed of annular disks joined together side by side and arranged along the shaft, each disk having polishing bristles or cleaning yarns implanted in its outer periphery, wherein keyways are formed in both a peripheral surface of the shaft and an inner peripheral surface of the disk; (iii) sunk keys fitted in the respective keyways, said sunk keys having a length not exceeding the length of the brush elements, each sunk key being expandable or contractable widthwise and tightly engageable in the keyway when being expanded, each sunk key being disengageable therefrom when being contracted; and (iv) retainers attached to the sunk keys to prevent the sunk keys from slipping out of the respective keyways when the sunk keys are contracted and fitted in the respective keyways.

* * * * *